US010619969B2

(12) United States Patent
Lee

(10) Patent No.: US 10,619,969 B2
(45) Date of Patent: Apr. 14, 2020

(54) SEMI-AUTOMATIC AIR GUN

(71) Applicant: Si Young Lee, Seoul (KR)

(72) Inventor: Si Young Lee, Seoul (KR)

( * ) Notice: Subject to any disclaimer, the term of this patent is extended or adjusted under 35 U.S.C. 154(b) by 246 days.

(21) Appl. No.: 15/812,333

(22) Filed: Nov. 14, 2017

(65) Prior Publication Data

US 2019/0128638 A1 May 2, 2019

(30) Foreign Application Priority Data

Oct. 31, 2017 (KR) ..... 10-2017-0143538

(51) Int. Cl.
*F41B 11/00* (2013.01)
*F41B 11/721* (2013.01)
*F41B 11/62* (2013.01)

(52) U.S. Cl.
CPC ..... *F41B 11/721* (2013.01); *F41B 11/62* (2013.01)

(58) Field of Classification Search
CPC ..... F41B 11/72; F41B 11/721; F41B 11/722; F41B 11/723
See application file for complete search history.

(56) References Cited

U.S. PATENT DOCUMENTS 5,063,905 A * 11/1991 Farrell ..... F41B 11/721 124/72
6,302,092 B1 * 10/2001 Juan ..... F41B 11/57 124/31
6,546,950 B1 * 4/2003 Juan ..... F16K 15/18 124/73
6,557,542 B1 * 5/2003 Orr ..... F41B 11/62 124/56
6,832,605 B2 * 12/2004 Farrell ..... F41A 11/06 124/76
7,617,816 B1 * 11/2009 Orr ..... F41B 11/73 124/31
2006/0027224 A1 * 2/2006 Lin ..... F41B 11/62 124/70
2006/0037597 A1 * 2/2006 Wood ..... F41B 11/721 124/73

FOREIGN PATENT DOCUMENTS

KR 19940009655 5/1994
KR 20130005152 1/2013

* cited by examiner

*Primary Examiner* — Gabriel J. Klein
(74) *Attorney, Agent, or Firm* — Cantor Colburn LLP

(57) ABSTRACT

Provided is a semi-automatic air gun that is capable of allowing a hammer to be loaded at the same time when pellets are fired, with a portion of the compressed air discharged from a compressed air tank so as to fire the bullets, so that the hammer and a pellet loading unit move horizontally together to permit the loading and firing of the pellets to be carried out in a semi-automatic manner, thereby making it simple in configuration and obtaining a remarkably excellent compressed air use efficiency.

5 Claims, 13 Drawing Sheets
(9 of 13 Drawing Sheet(s) Filed in Color)

SEMI-AUTOMATIC AIR GUN

BACKGROUND OF THE INVENTION

Cross Reference to Related Application of the Invention

The present application claims the benefit of Korean Patent Application No. 10-2017-0143538 filed in the Korean Intellectual Property Office on Oct. 31, 2017, the entire contents of which are incorporated herein by reference.

Field of the Invention

The present invention relates to a semi-automatic air gun, and more particularly, to a semi-automatic air gun that is capable of allowing a hammer to be loaded at the same time when pellets are fired, with a portion of the compressed air discharged from a compressed air tank so as to fire the bullets, so that the hammer and a pellet loading unit move horizontally together to permit the loading and firing of the pellets to be carried out in a semi-automatic manner, thereby making it simple in configuration and obtaining a remarkably excellent compressed air use efficiency.

Background of the Related Art

Generally, air guns are used to compress and store air in a compression tank, to move a pellet from a magazine to a cartridge chamber to load the pellet through the manipulation of pellet loading means, and finally to pull a trigger to allow the pellet loaded in the cartridge chamber to be fired with the compressed air stored in the compression tank.

Among such air guns, an air gun, which uses a rotary magazine capable of loading the pellet to the cartridge chamber while rotating, is generally known. By the way, the conventional air guns are generally configured to allow the pellet to be loaded in the cartridge chamber through the manipulation of a loading lever by a user's hand. Accordingly, it is impossible to continuously fire pellets.

So as to solve the above-mentioned problems, on the other hand, a semi-automatic air gun is disclosed (in Korean Patent Application Laid-open No. 10-1994-09655), which reuses the compressed air used to fire a pellet to allow another pellet to be reloaded. However, the conventional semi-automatic air gun uses the compressed air used to fire the pellet so as to reload a loading lever, so that it is hard to control the pressure, and if the air pressure of a compressed air tank becomes low, it is impossible to perform the reloading.

On the other hand, a fully automatic air gun using a motor is disclosed (in Korean Patent Application Laid-open No. 10-2013-05152), but the conventional fully automatic air gun is complicated in configuration, thereby making it hard to manufacture. In addition, inconveniently, the conventional fully automatic air gun should exchange a battery for driving the motor.

SUMMARY OF THE INVENTION

Accordingly, the present invention has been made in view of the above-mentioned problems occurring in the prior art, and it is an object of the present invention to provide a semi-automatic air gun that is capable of allowing a hammer to be loaded at the same time when pellets are fired, with a portion of the compressed air discharged from a compressed air tank so as to fire the bullets, so that the hammer and a pellet loading unit move horizontally together to permit the loading and firing of the pellets to be carried out in a semi-automatic manner, thereby making it simple in configuration and obtaining a remarkably excellent compressed air use efficiency.

To accomplish the above-mentioned object, according to the present invention, there is provided a semi-automatic air gun including: a main body; a barrel fixedly located on a barrel installation hole formed on the main body and having a compressed air introduction hole formed on a front end thereof; a valve fixedly disposed in a valve installation hole formed in parallel with the barrel installation hole of the main body to discharge air in a compressed air tank coupled to one end thereof toward the barrel; a valve control unit horizontally movable in an internal space of the valve to control the compressed air discharged through the valve; a hammer pusher slidingly movably inserted into a pusher installation hole formed on the valve and having one end coupled to the valve control unit to move the valve control unit horizontally in such a manner as to allow a portion of the compressed air discharged from the valve to be supplied backwardly to move a hammer; the hammer slidingly movable along a hammer moving path formed in the main body in such a manner as to insert the other end of the hammer pusher thereinto and adapted to horizontally move the hammer pusher and the valve control unit in such a manner as to move backwardly by means of the compressed air supplied through the hammer pusher and to move forwardly by means of an elastic force of an elastic part disposed in the hammer moving path; a trigger unit coupled to underside of the main body and adapted to lock a lower end of a front end periphery of the hammer thereonto to prevent the hammer from moving forwardly in the state where the hammer moves backwardly and to move the hammer forwardly by means of a user's manipulation; and a pellet loading unit slidingly movable along a pellet loading unit installation groove formed in the main body and adapted to horizontally move together with the hammer to allow a pellet to be loaded into the barrel and to supply the compressed air supplied to the barrel toward the front side of the barrel.

According to the present invention, desirably, the valve includes: a control unit installation hole open toward the compressed air tank to provide a moving space of the valve control unit and a path for discharging the compressed air; the pusher installation hole open toward the hammer pusher in such a manner as to have a smaller diameter than the control unit installation hole and adapted to provide a sliding moving path of the hammer pusher; and a first compressed air moving hole formed to pass through a side wall of the valve toward the barrel from the pusher installation hole to provide a path along which the compressed air moves toward the barrel.

According to the present invention, desirably, the valve control unit includes: a blocking member made of an elastic material to block an entrance of the pusher installation hole; a blocking member cap made of a hard material and coupled to a rear end of the blocking member in such a manner as to be coupled to an end periphery of the hammer pusher; and a first elastic member disposed in the control unit installation hole to pressurize the blocking member and the blocking member cap toward the pusher installation hole by means of an elastic force thereof.

According to the present invention, desirably, the hammer pusher includes: a small diameter part inserted into the pusher installation hole in such a manner as to be spaced apart from an inner peripheral surface of the pusher installation hole and to be coupled to the valve control unit at an end periphery thereof; a large diameter part inserted into the pusher installation hole in such a manner as to be brought into close contact with the inner peripheral surface of the pusher installation hole and to be coupled to a rear end periphery of the small diameter part; a second compressed air moving hole formed to pass through an interior of the large diameter part in a longitudinal direction in such a manner as to have one end open toward the hammer and the other end open toward a small diameter part side end portion of the large diameter part; and a hammer locking portion protruding outwardly from an outer peripheral surface of the large diameter part and adapted to lock the front end periphery of the hammer thereonto upon a forward movement of the hammer to allow the hammer pusher to be pressurized toward the valve.

According to the present invention, desirably, the hammer includes: a pusher insertion groove open toward the hammer pusher in such a manner as to allow the hammer pusher to come into close contact therewith; and a pin insertion groove concavedly formed on an outer surface of the hammer.

According to the present invention, desirably, the pellet loading unit includes: a loading housing slidingly movable along the pellet loading unit installation groove in such a manner as to be connected to the hammer and to move horizontally together with the hammer; a loading rod coupled to a front end of the loading housing in such a manner as to move forwardly and backwardly together with the loading housing and adapted to push the pellet into the barrel; and a connection pin coupled to underside of the loading housing and having a lower end adapted to be inserted into the pin insertion groove to allow a horizontal movement of the hammer to be operated cooperatively with a horizontal movement of the loading housing.

According to the present invention, desirably, the loading rod includes: a front end peripheral portion having a smaller diameter than an inner diameter of the barrel and adapted to move forwardly in such a manner as to pass through the compressed air introduction hole in the state of moving forwardly toward the barrel to allow the pellet to be pushed forwardly than the compressed air introduction hole; and a rear end peripheral portion having a given diameter capable of being brought into close contact with an inner peripheral surface of the barrel and adapted to connect the front end peripheral portion and the loading housing to each other at a rear end periphery of the front end peripheral portion.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
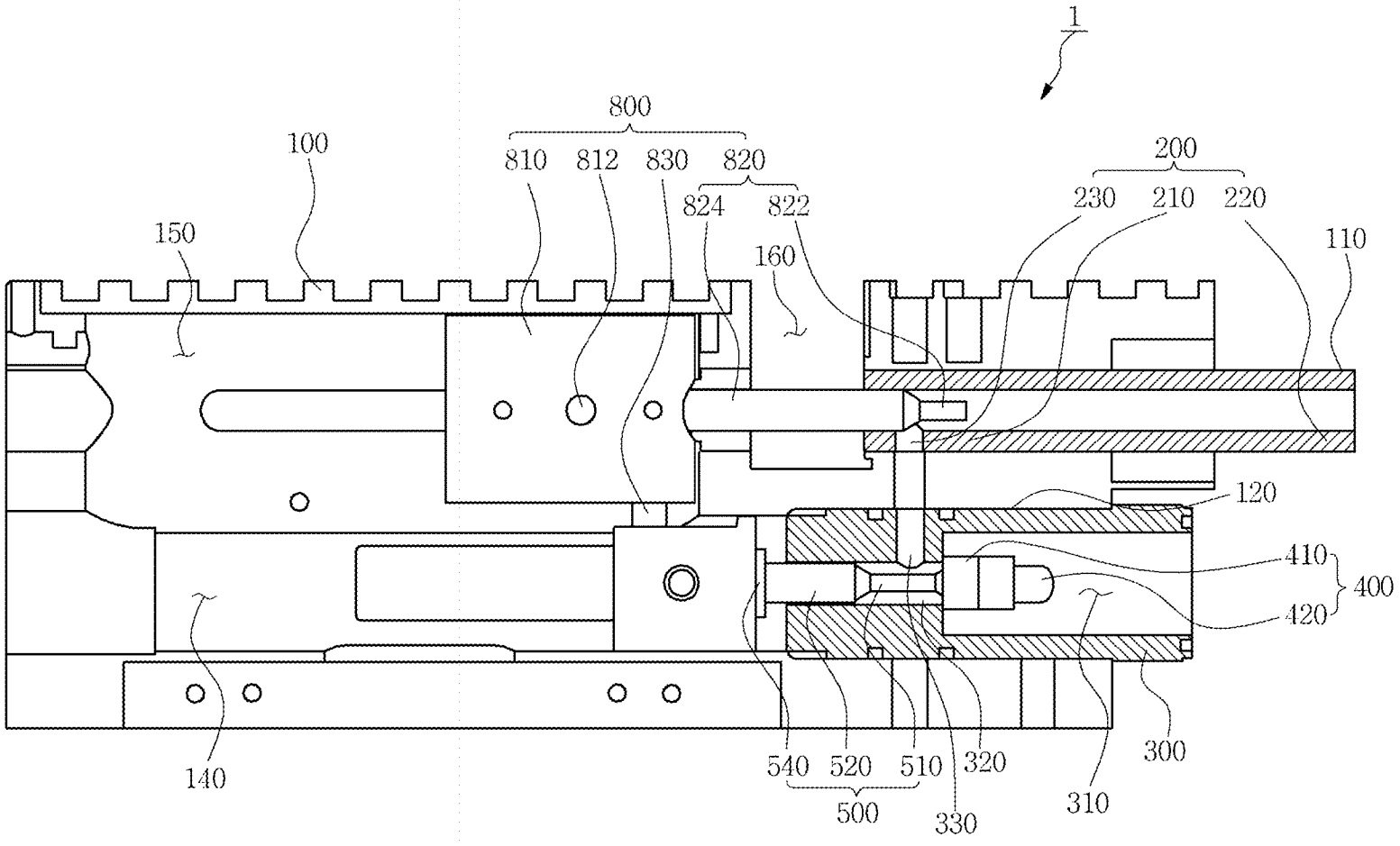
FIG. 1 is a sectional view showing the internal configuration of a semi-automatic air gun according to the present invention.

Now, an explanation on a semi-automatic air gun according to the present invention will be given with reference to the attached drawings.

As shown in FIGS. 1 to 4, a semi-automatic air gun 1 according to the present invention includes a main body 100, a barrel 200, a valve 300, a valve control unit 400, a hammer pusher 500, a hammer 600, a trigger unit 700, and a pellet loading unit 800.

First, the main body 100 constitutes the whole outer shape of the semi-automatic air gun 1 according to the present invention and also provides a given space in which other components are disposed. The detailed structure of the main body 100 will be explained in detail, while other components are being described below. Of course, other components like a buttstock for constituting the air gun may be disposed on the main body 100.

Figure 2:
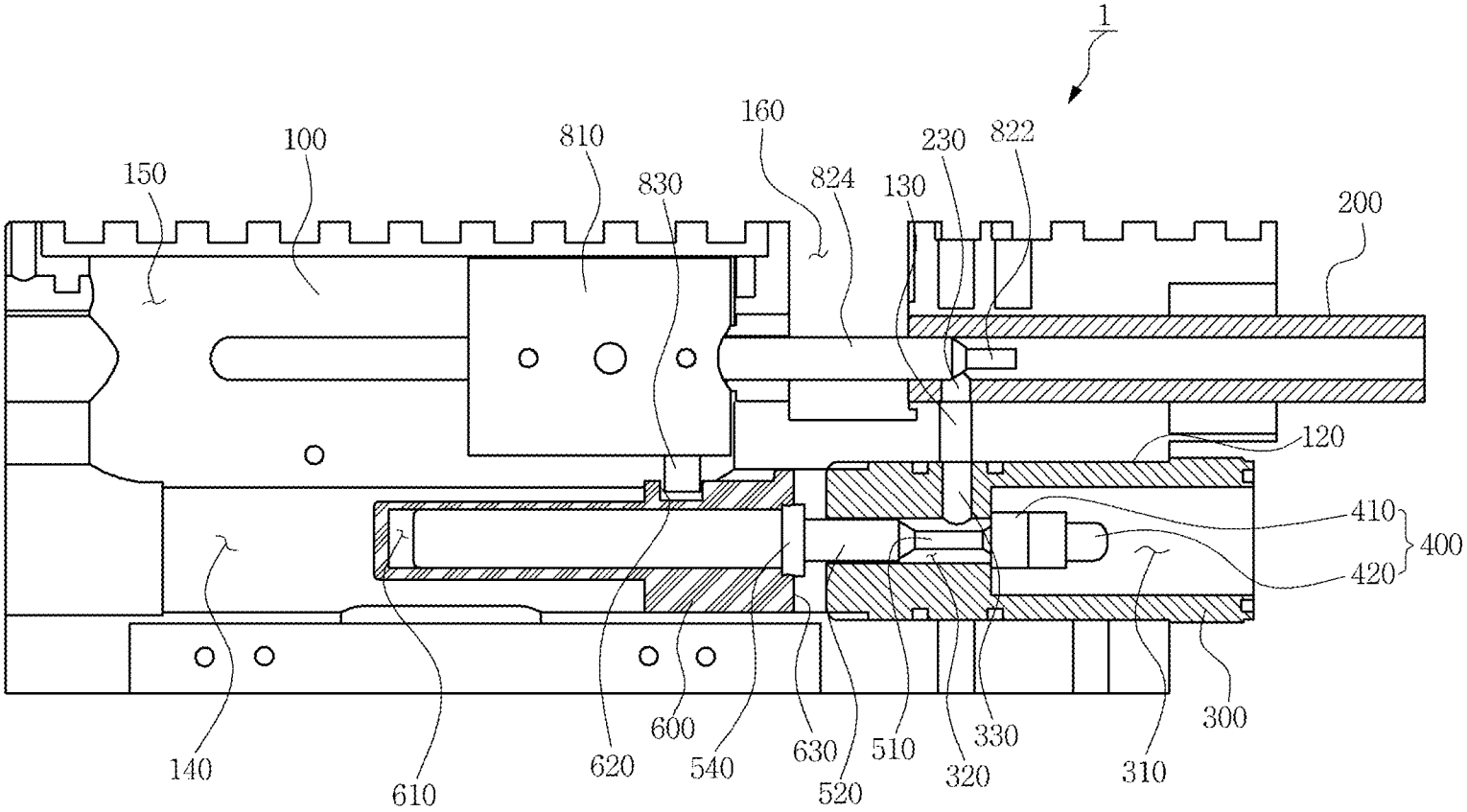
FIG. 2 is a sectional view showing the internal configuration of a valve and a hammer of the semi-automatic air gun according to the present invention.
Figure 3:
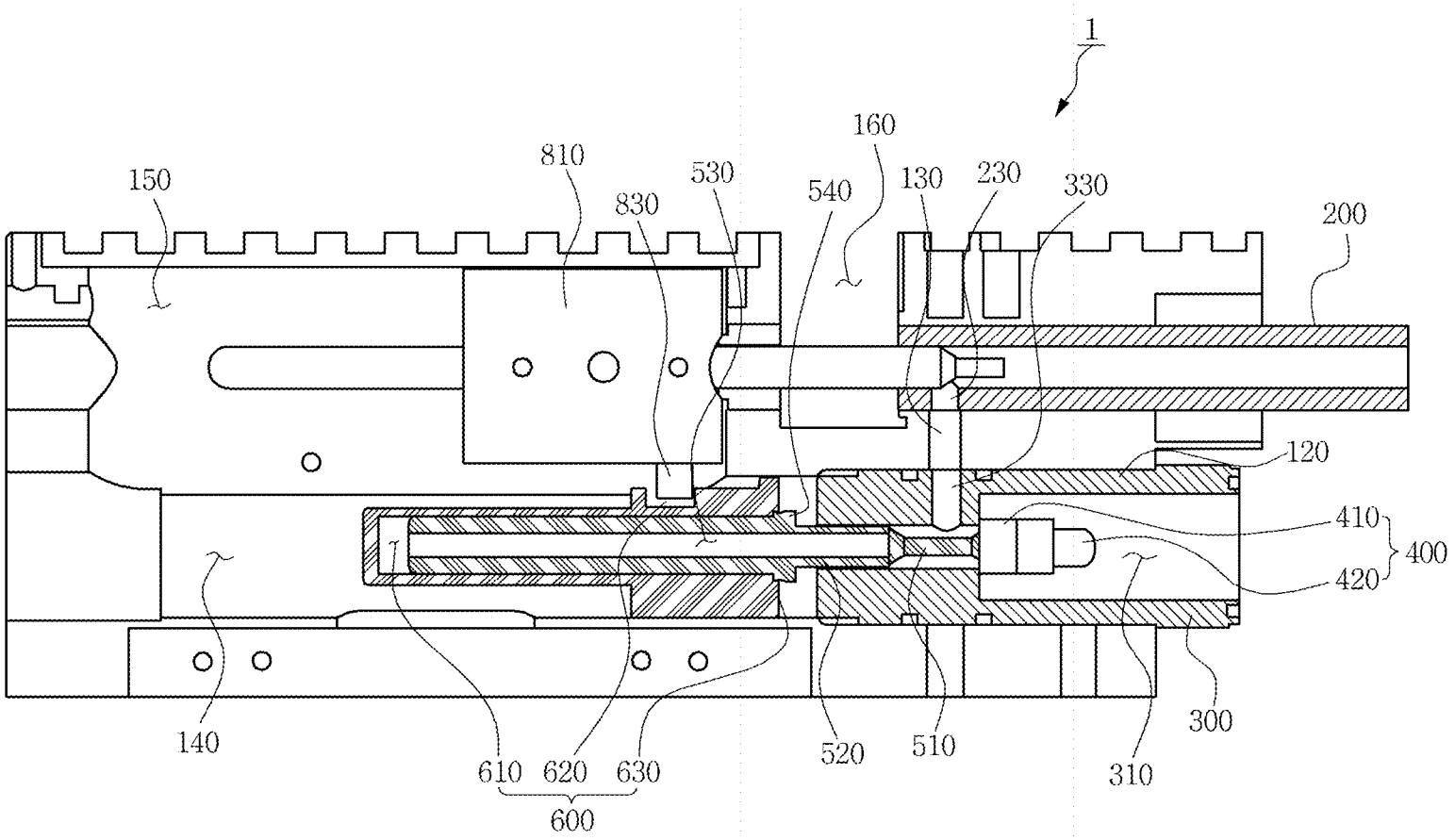
FIG. 3 is a sectional view showing the internal configuration of a hammer pusher of the semi-automatic air gun according to the present invention.

Next, as shown in FIGS. 1 to 3, the barrel 200 is fixedly located on a barrel installation hole 110 formed on the main body 100 and serves to provide a path along which a pellet is fired. Accordingly, the barrel 200 takes a shape of a generally long pipe and has a front end portion 210 fixedly coupled to the barrel installation hole 110 of the main body 100 and the other end portion 220 exposed to the outside.

According to the present invention, as shown in FIGS. 2 and 3, the barrel 200 has a compressed air introduction hole 230 formed on the front end thereof in such a manner as to pass through the side surface thereof. The compressed air introduction hole 230 communicates with a first compressed air moving hole 330 as will be discussed later and serves as a path for supplying the compressed air supplied through the first compressed air moving hole 330 toward the barrel 200 so as to fire a pellet (not shown) loaded in the barrel 200.

Next, as shown in FIGS. 1 to 4, the valve 300 is fixedly disposed in a valve installation hole 120 formed in parallel with the barrel installation hole 110 of the main body 100 and serves as a component for discharging air in a compressed air tank (not shown) coupled to one end thereof toward the barrel 200. In more detail, the valve 300 has a generally cylindrical shape and is coupled to the main body 100 at a rear end thereof and to an entrance of the compressed air tank at a front end thereof. Of course, the compressed air tank is easily separatedly coupled to the valve 300 in such a manner as to be exchangeable.

Further, as shown in FIGS. 1 to 4, the valve 300 has a control unit installation hole 310 and a pusher installation hole 320 formed as given internal spaces therein in such a manner as to communicate with each other to allow the valve control unit 400 as will be discussed later to be driven and also to allow the compressed air to pass therethrough. The control unit installation hole 310 is open toward the compressed air tank and serves to provide a moving space of the valve control unit 400 and a path for discharging the compressed air. Accordingly, an inner diameter of the control unit installation hole 310 is larger than a diameter of the valve control unit 400, so that in spite of the existence of the valve control unit 400, the control unit installation hole 310 provides a given space through which the compressed air passes.

Further, as shown in FIGS. 1 to 4, the pusher installation hole 320 is open toward the hammer pusher 500 in such a manner as to have a smaller diameter than the control unit installation hole 310 and serves to provide a sliding moving path of the hammer pusher 500. At this time, an inner diameter of the pusher installation hole 320 is almost the same as a diameter of a large diameter part 520 as will be discussed later, so that the large diameter part 520 slides in the state of being almost brought into close contact with an inner peripheral surface of the pusher installation hole 320, thereby desirably preventing the compressed air from leaking.

According to the present invention, moreover, the valve 300 has the first compressed air moving hole 330 as mentioned above. As shown in FIGS. 2 and 3, the first compressed air moving hole 330 is formed to pass through a side wall of the valve 300 toward the barrel 200 from the pusher installation hole 320 and serves to provide a path along which the compressed air moves to the barrel 200.

As a result, the first compressed air moving hole 330 communicates with a third compressed air moving hole 130 formed on the main body 100 and the compressed air introduction hole 230 to allow the compressed air passing through the valve 300 to finally reach the barrel 200.

Next, as shown in FIGS. 1 to 4, the valve control unit 400 is horizontally movable in an internal space of the valve 300 and serves as a component for controlling a flow of the compressed air discharged through the valve 300. In more detail, the valve control unit 400 is brought into close contact with a front end periphery of the pusher installation hole 320 or is spaced apart therefrom to allow the flow of the compressed air through the pusher installation hole 320 to be controlled.

According to the present invention, in more detail, the valve control unit 400 includes a blocking member 410, a blocking member cap 420, and a first elastic member (not shown). First, the blocking member 410 is made of an elastic material and is brought into close contact with an entrance of the pusher installation hole 320 to block the pusher installation hole 320. The blocking member 410 is made of an elastic member like rubber and is pressurized toward the pusher installation hole 320 by means of the first elastic member to prevent the compressed air from being discharged through the pusher installation hole 320.

Also, as shown in FIGS. 2 and 3, the blocking member cap 420 is made of a hard material and is coupled to a rear end periphery of the blocking member 410 in such a manner as to be coupled to an end periphery of the hammer pusher 500. Unlike the blocking member 410 made of the soft material having elasticity, in more detail, the blocking member cap 420 is made of the hard material so that it can be stably coupled to the end periphery of the hammer pusher 500, and also, a horizontal moving path of the blocking member 410 can be constantly maintained.

Next, the first elastic member is disposed in the control unit installation hole 310 and serves as a component for always pressurizing the blocking member 410 and the blocking member cap 420 toward the pusher installation hole 320 by means of an elastic force thereof. Accordingly, the blocking member 410 is pressurized toward the pusher installation hole 320 unless the blocking member 410 and the blocking member cap 420 are pushed in an opposite direction to the pusher installation hole 320 by means of a force exceeding the elastic force of the first elastic member.

Of course, a pressure in the interior of the valve 300 is applied to the pusher installation hole 320 by means of the compressed air of the compressed air tank coupled to the front end periphery of the valve 300, and even if the first elastic member is not provided, accordingly, the blocking member 410 can be pressurized toward the pusher installation hole 320. Therefore, the first elastic member may be not provided.

Next, as shown in FIGS. 1 to 3, the hammer pusher 500 is slidingly inserted into the pusher installation hole 320 formed on the valve 300 to move the valve control unit 400, so that the compressed air in the valve 300 moves toward the barrel 200 and at the same time a portion of the compressed air is supplied to the hammer 600 in such a manner as to be used as the compressed air for moving the hammer 600.

In more detail, as shown in FIGS. 1 to 3, the hammer pusher 500 according to the present invention includes a small diameter part 510, the large diameter part 520, a second compressed air moving hole 530, and a hammer locking portion 540. First, as shown in FIGS. 1 to 3, the small diameter part 510 is inserted into the pusher installation hole 320 and has a smaller diameter than the inner diameter of the pusher installation hole 320 so that it is inserted into the pusher installation hole 320 in the state of being spaced apart from the inner peripheral surface of the pusher installation hole 320. Further, the small diameter part 510 is coupled to the valve control unit 400 at an end periphery thereof. As the small diameter part 510 moves horizontally, accordingly, the valve control unit 400 also moves horizontally.

Next, as shown in FIGS. 1 to 3, the large diameter part 520 is insertedly brought into close contact with the inner peripheral surface of the pusher installation hole 320 in such a manner as to have an almost similar diameter to the inner diameter of the pusher installation hole 320. Accordingly, only a substantially fine gap is formed between the pusher installation hole 320 and the large diameter part 520, so that a quantity of air movable through the gap is very limited. Further, a front end periphery of the large diameter part 520 is coupled to a rear end periphery of the small diameter part 510, and in some cases, the large diameter part 520 is formed unitarily with the small diameter part 510, while having the different diameter from the small diameter part 510.

Figure 5:
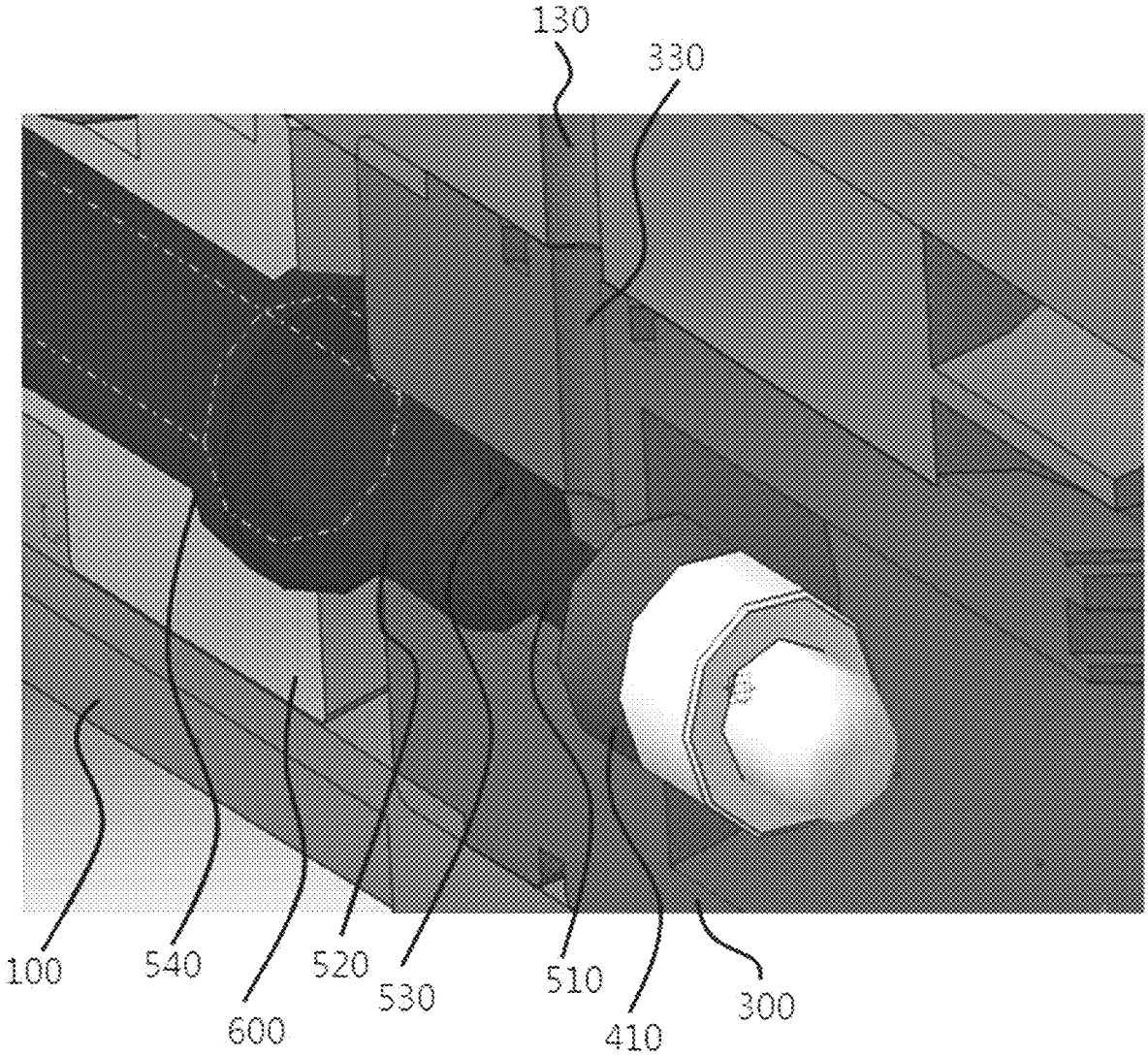
FIG. 5 is a partially perspective view showing the configuration of a hammer pusher of the semi-automatic air gun according to the present invention.

After that, as shown in FIG. 3, the second compressed air moving hole 530 is formed to pass through an interior of the large diameter part 520 in a longitudinal direction in such a manner as to have one end open toward the hammer 600 and the other end open toward a small diameter part side end portion of the large diameter part 520. Especially, as shown in FIG. 5, a small diameter part side end of the second compressed air moving hole 530 is formed small on the boundary between the large diameter part 520 and the small diameter part 510, and a hammer side end thereof is formed large toward the hammer 600. Accordingly, the compressed air for moving the hammer 600 backwardly moves through the second compressed air moving hole 530.

Next, as shown in FIGS. 1 to 4, the hammer locking portion 540 protrudes outwardly from an outer peripheral surface of the large diameter part 520 and is adapted to lock the front end portion of the hammer 600 thereonto upon a forward movement of the hammer 600 to allow the hammer pusher 500 to be pressurized toward the valve 300. As shown in FIG. 1, the hammer locking portion 540 is formed on the outer peripheral surface of the large diameter part 520 so that the blocking member 310 is spaced apart from the end periphery of the valve 300 at a given distance in the state of being brought into close contact with the pusher installation hole 320.

Figure 10:
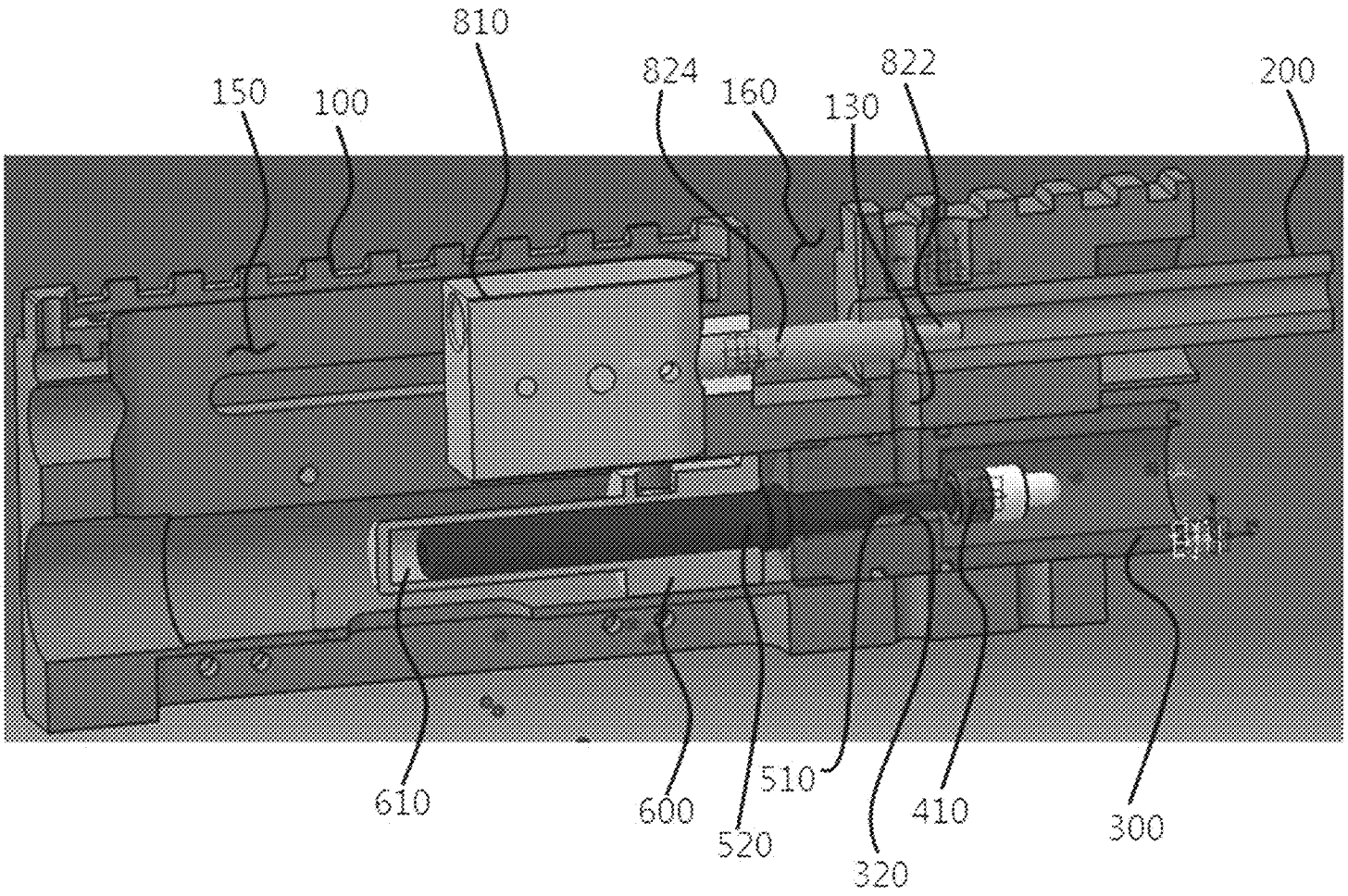

As the front end portion of the hammer 600 moves toward the valve 300, accordingly, it becomes locked onto the hammer locking portion 540, and if the hammer 600 pressurizes the hammer pusher 500 toward the valve 300 with a larger force than the elastic force of the first elastic member, as shown in FIG. 10, the hammer pusher 500 and the valve control unit 400 at the same time move further toward the valve 300, so that the pusher installation hole 320 becomes open.

After that, as shown in FIGS. 1 to 4, the hammer 600 is slidingly movable along a hammer moving path 140 formed in the main body 100 and serves to horizontally move the hammer pusher 500 and the valve control unit 400 in such a manner as to move backwardly by means of the compressed air supplied through the hammer pusher 500 and to move forwardly by means of an elastic force of an elastic part (not shown) disposed on the hammer moving path 140.

In more detail, the whole function of the semi-automatic air gun 1 according to the present invention is carried out by means of the horizontal movement of the hammer 600, and basically, the hammer 600 is kept pressurized strongly toward the valve 300 by means of the elastic force of the elastic part, while moving backwardly only when a force exceeding the elastic force of the elastic part is applied from the second compressed air moving hole 530 in an opposite direction to the valve 300.

According to the present invention, to this end, the hammer 600 has a shape of a general cylinder having a rear end closed, and in more detail, as shown in FIGS. 1 to 4, the hammer 600 includes a pusher insertion groove 610, a pin insertion groove 620, and a trigger unit-locked portion 630. First, as shown in FIG. 1, the pusher insertion groove 610 is open toward the hammer pusher 500 in such a manner as to allow the hammer pusher 500 to come into close contact therewith. Accordingly, an inner diameter of the pusher insertion groove 610 is almost the same as a diameter of the large diameter part 520 of the hammer pusher 500, so that the pusher insertion groove 610 and the large diameter part are brought into close contact with each other to have almost no space isolated between the large diameter part 520 and the hammer 600.

If the large diameter part 520 and the hammer 600 come into close contact with each other, like this, the compressed air supplied through the second compressed air moving hole 530 is used to push the hammer 600 backwardly, without any leakage to the outside.

Figure 4:
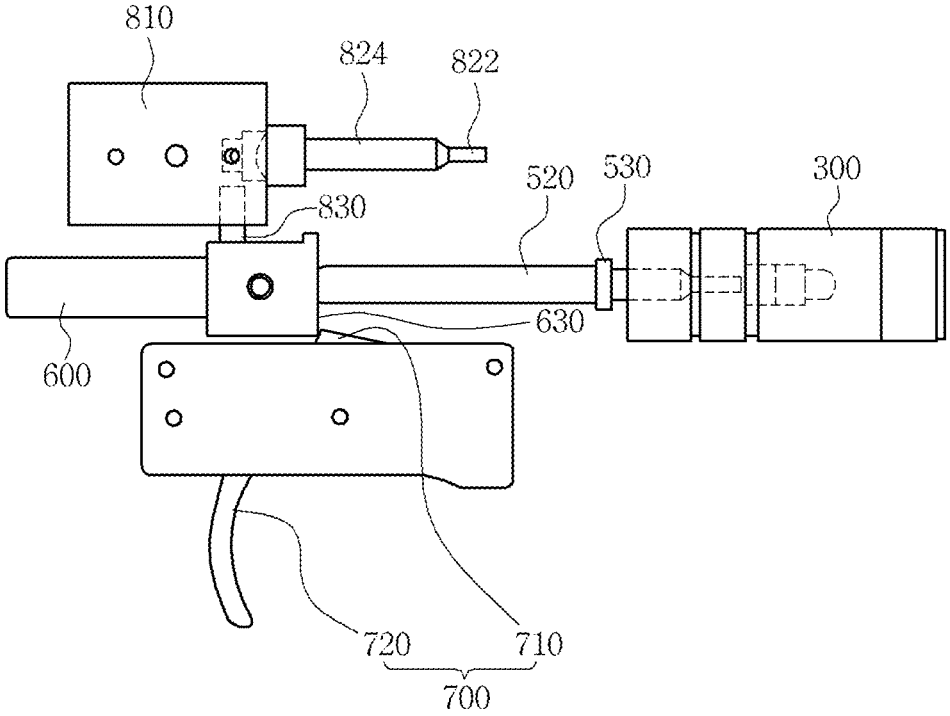
FIG. 4 is a side view showing the coupling relation between a trigger unit and the hammer of the semi-automatic air gun according to the present invention.

Next, as shown in FIG. 4, the pin insertion groove 620 is concavedly formed on an outer surface of the hammer 600 so as to insert a lower end of a connection pin 830 as will be discussed later thereinto. Accordingly, the pin insertion groove 620 desirably has a given size capable of being completely brought into close contact with the connection pin 830 to prevent no gap from occurring in the state of inserting the lower end of the connection pin 830 thereinto, so that the hammer 600 can be perfectly operated cooperatively with the pellet loading unit 800.

Next, as shown in FIG. 4, the trigger unit-locked portion 630 protrudes outwardly from a front outer peripheral surface of the hammer 600 in such a manner as to be locked onto the trigger unit 700 in the state where the hammer 600 moves backwardly. Like this, the state where the trigger unit-locked portion 630 is locked onto the trigger unit 700 is a loaded state, and in this state, if the trigger unit 700 is pulled by a user, the hammer 600 moves forwardly toward the valve 300, so that the pellet is fired and the reloading of the hammer 600 is carried out.

After that, as shown in FIG. 4, the trigger unit 700 is coupled to underside of the main body 100 in such a manner as to lock a lower end of the hammer 600 thereonto to prevent the hammer 600 from moving forwardly in the state where the hammer 600 moves backwardly and also in such a manner as to move the hammer 600 forwardly by means of the user's manipulation. According to the present invention, to this end, the trigger unit 700 includes a locking projection 710 onto which the trigger unit-locked portion 630 is locked, a trigger 720 formed unitarily with the locking projection 710 and pressurized by the user's fingers, a hinge part (not shown) for rotatably coupling the locking projection 710 and the trigger 720 to the main body 100, and a second elastic member (not shown) for pressurizing the locking projection 710 to the always upwardly protruding state.

Next, as shown in FIGS. 1 to 4, the pellet loading unit 800 is slidingly movable along a pellet loading unit installation groove 150 formed in the main body 100 and serves to horizontally move together with the hammer 600 to allow a pellet to be loaded into the barrel 200 and to supply the compressed air supplied to the barrel 200 toward the front side of the barrel 200. According to the present invention, to this end, the pellet loading unit 800 includes a loading housing 810, a loading rod 820, and the connection pin 830.

First, as shown in FIGS. 1 to 3, the loading housing 810 is slidingly movable along the pellet loading unit installation groove 150 in such a manner as to be connected to the hammer 600 and to move horizontally together with the hammer 600. The loading housing 810 is coupled to the loading rod 820 and the connection pin 830.

So as to perform initial firing of the semi-automatic air gun 1 according to the present invention, further, a loading lever (not shown) is coupled to a side surface of the loading housing 810 to allow the hammer 600 and the pellet loading unit 800 to be in a loaded state. Accordingly, as shown in FIG. 1, the loading lever is coupled to a lever coupling portion 812 formed on the side surface of the loading housing 810 in such a manner as to protrude outwardly from the main body 100, so that it is held by the user.

Next, as shown in FIGS. 1 to 3, the loading rod 820 is coupled to a front end of the loading housing 810 in such a manner as to move forwardly and backwardly together with the loading housing 810 and serves as a component for pushing the pellet into the barrel 200. According to the present invention, the loading rod 820 serves to push the pellet to a firing position of the barrel 200 and to seal the opposite side of the barrel 200 to a firing side of the barrel 200 to allow the compressed air supplied toward the barrel 200 to move only toward the pellet in the state where the pellet has been pushed to the firing side.

According to the present invention, to this end, the loading rod 820 includes a front end peripheral portion 822 and a rear end peripheral portion 824, as shown in FIGS. 1 to 3. First, a diameter of the front end peripheral portion 822 is smaller than an inner diameter of the barrel 200, and the front end peripheral portion 822 serves to pass through the compressed air introduction hole 230 in the state of moving forwardly toward the barrel 200 to allow the pellet to be pushed forwardly than the compressed air introduction hole 230. That is, the front end peripheral portion 822 comes into direct contact with a rear surface of the pellet to push the pellet to the firing position of the barrel 200, and the diameter of the front end peripheral portion 822 is smaller than the inner diameter of the barrel 200, so that even if the front end peripheral portion 822 passes through the compressed air introduction hole 230 and then moves forwardly, a space in which the compressed air is movable toward the barrel 200 can be ensured.

Figure 12:
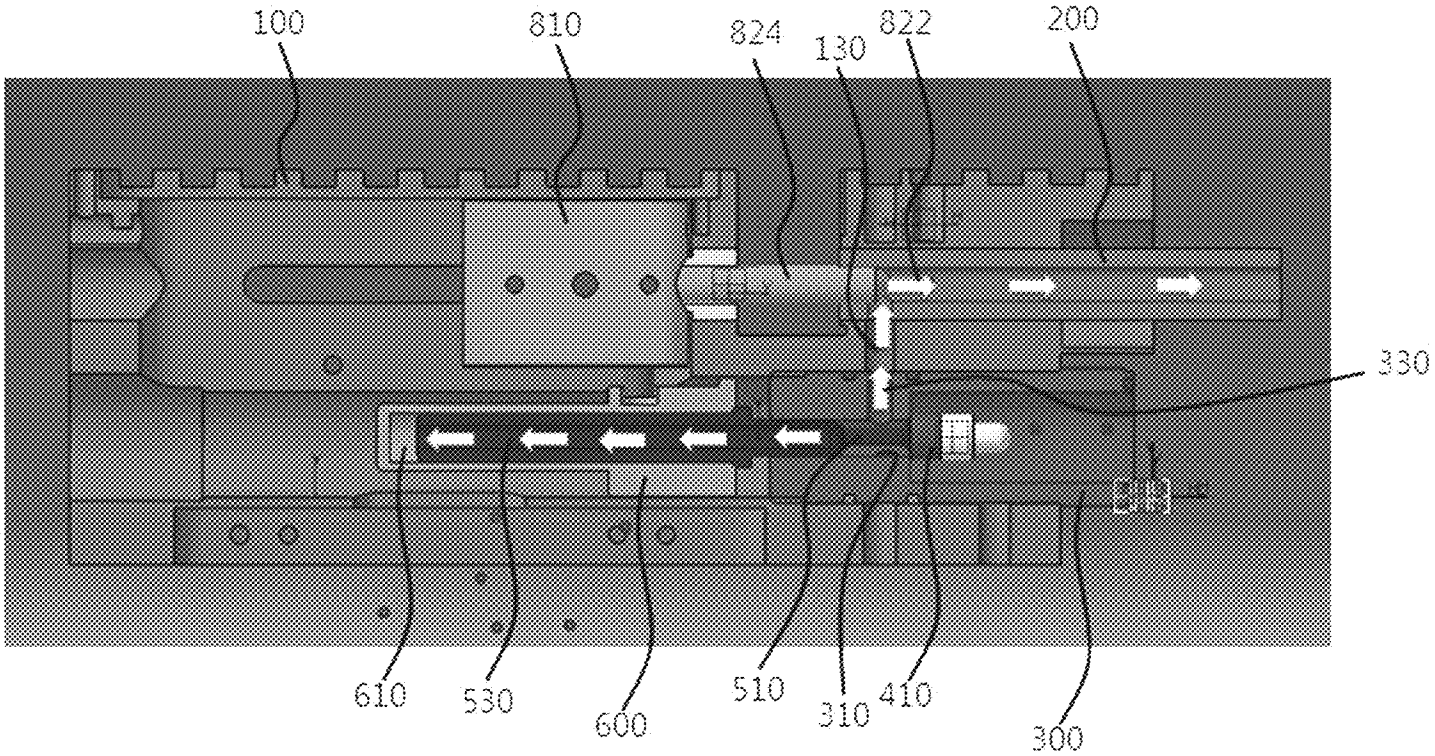

On the other hand, the rear end peripheral portion 824 has a given diameter so that it is brought into close contact with an inner peripheral surface of the barrel 200 and serves to connect the front end peripheral portion 822 and the loading housing 810 to each other at a rear end periphery of the front end peripheral portion 822. Accordingly, the rear end peripheral portion 824 comes into almost close contact with the inner peripheral surface of the barrel 200 in the state of being inserted into the barrel 200, so that no compressed air can pass therethrough. As a result, as shown in FIG. 12, the compressed air supplied to the barrel 200 moves only toward the pellet by means of the rear end peripheral portion 824.

Next, as shown in FIGS. 1 to 3, the connection pin 830 is coupled to underside of the loading housing 810 and has the lower end adapted to be inserted into the pin insertion groove 620 to allow a horizontal movement of the hammer 600 to be operated cooperatively with a horizontal movement of the loading housing 810. Through the connection pin 830, that is, the loading housing 810 and the hammer 600 move horizontally at the same time, thereby allowing the semi-automatic air gun 1 according to the present invention to be activated.

Under the above-mentioned configuration, hereinafter, an explanation on the operating processes of the semi-automatic air gun 1 according to the present invention will be given.

Figure 6:
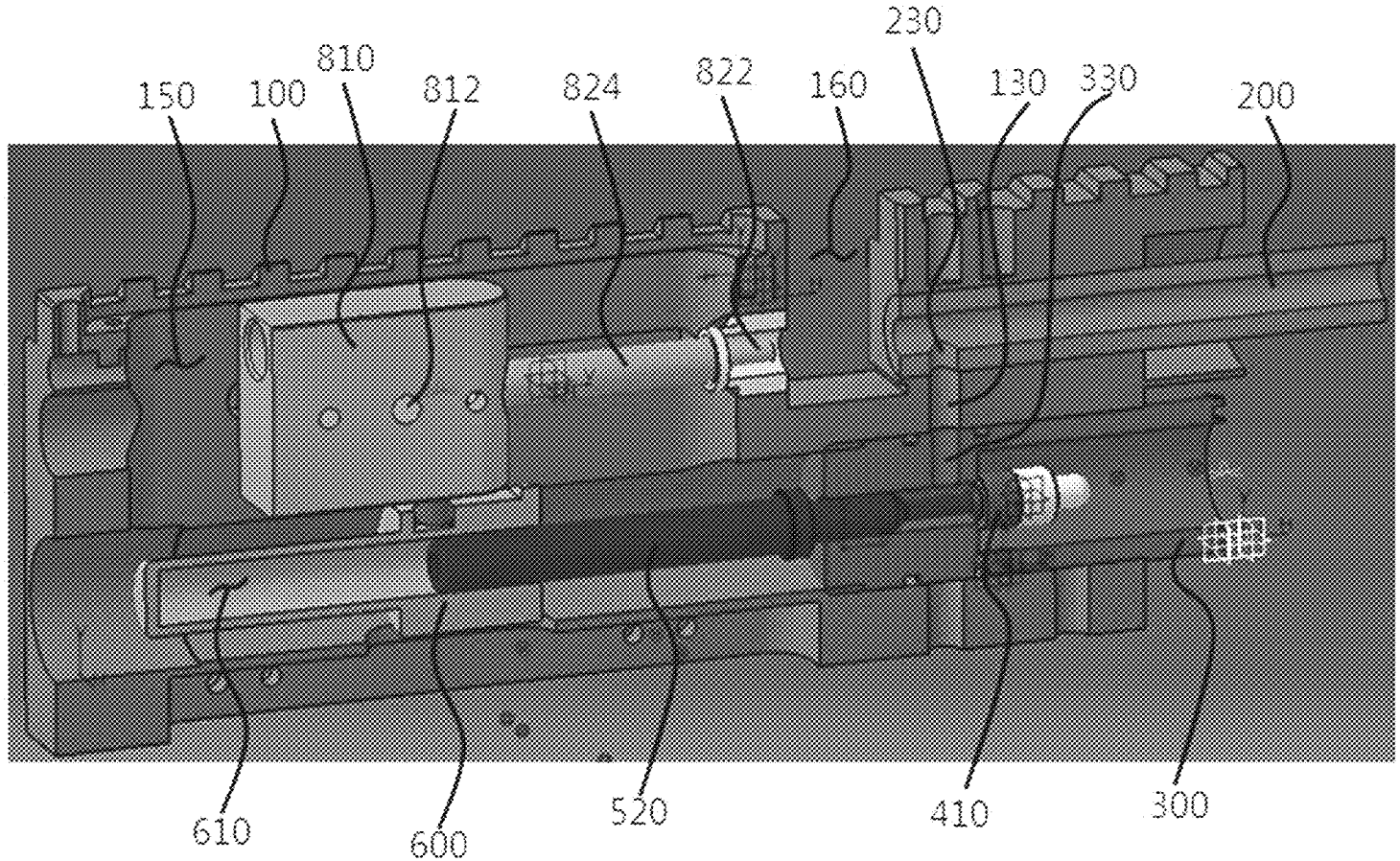
FIG. 6 is a sectional view showing the loading state of the semi-automatic air gun according to the present invention.

If the loading lever is first pulled by the user to perform initial firing thus to move the loading housing 810 and the hammer 600 to a loading position, as shown in FIG. 6, the loading housing 810 and the hammer 600 move backwardly together, and accordingly, the loading rod 820 completely moves backwardly to a rear side than a pellet coupling portion 160. Accordingly, the hammer pusher 500 becomes free to allow the valve control unit 400 to move toward the hammer 600 to the maximum by means of the elastic force of the first elastic member pushing the valve control unit 400 toward the hammer 600. In this state, of course, the valve control unit 400 blocks the pusher installation hole 320, and the trigger unit-locked portion 630 is locked onto the locking projection 710.

Figure 7:
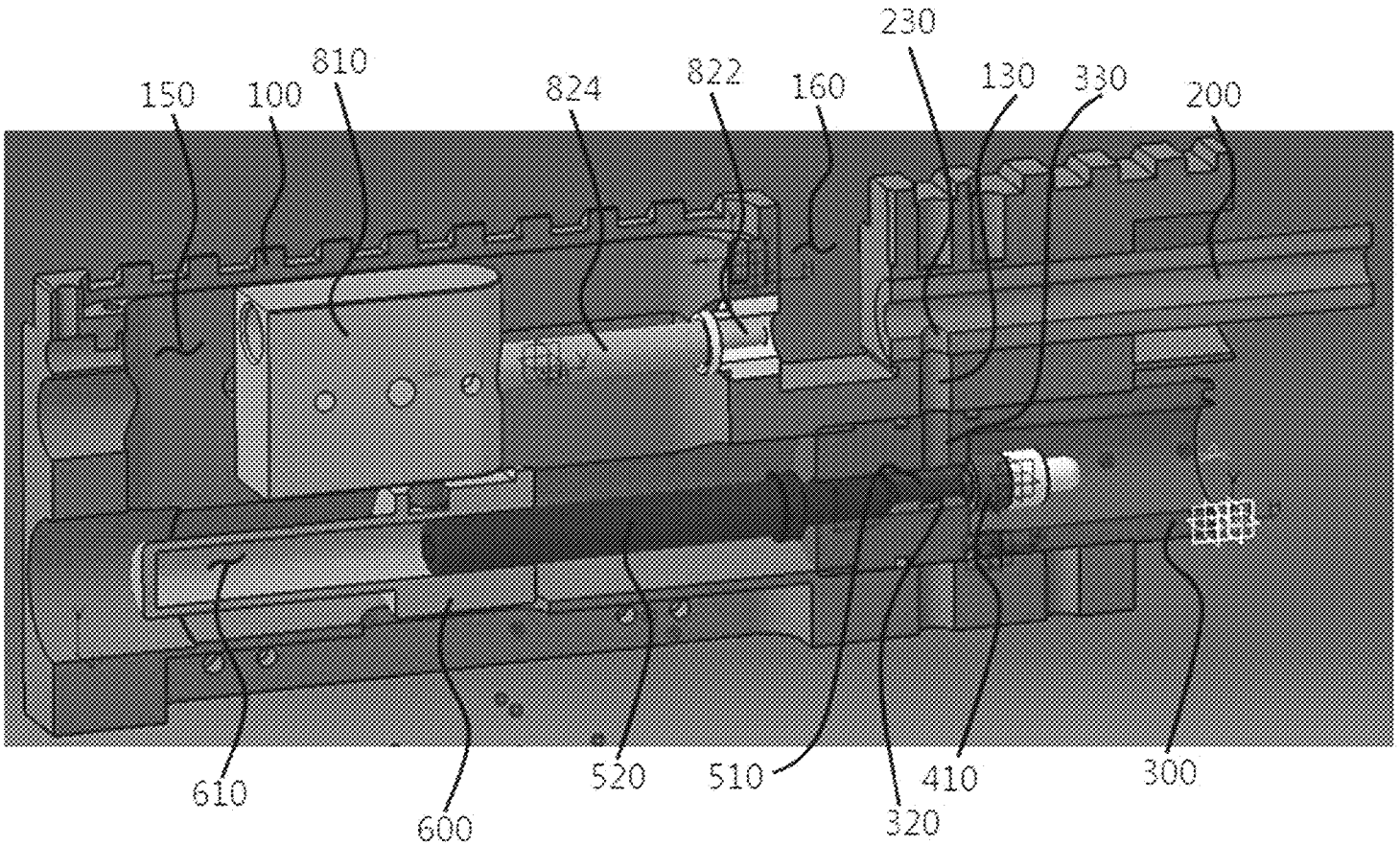
FIGS. 7 to 13 are sectional views showing the firing and reloading processes in the semi-automatic air gun according to the present invention.

If the trigger is pulled by the user, in this state, the locking projection 710 moves down and the trigger unit-locked portion 630 becomes free. As a result, as shown in FIG. 7, the hammer 600 starts to move forwardly by means of the strong elastic force of the elastic part. When the hammer 600 moves forwardly, of course, the loading housing 810 moves forwardly, so that the loading rod 820 coupled to the front surface of the loading housing 810 passes through the pellet coupling portion 160 to push the pellet inserted into a magazine toward the barrel 200.

Figure 8:
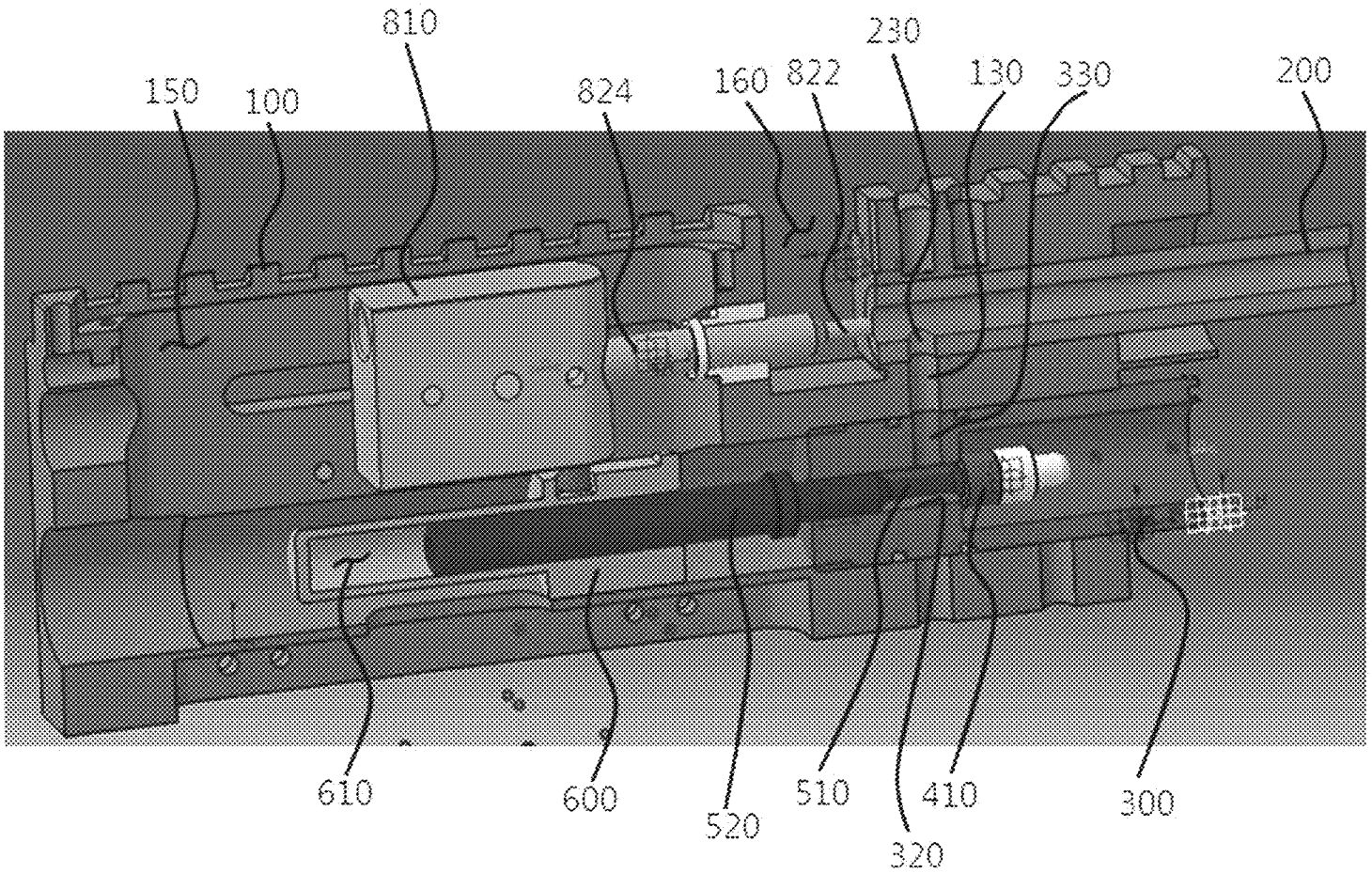

As shown in FIG. 8, if the front end portion of the hammer 600 moves forwardly to the position where it is locked onto the hammer locking portion 530 while the hammer 600 is moving forwardly, the hammer 600 does not move anymore so that it hits the hammer pusher 500.

Figure 9:
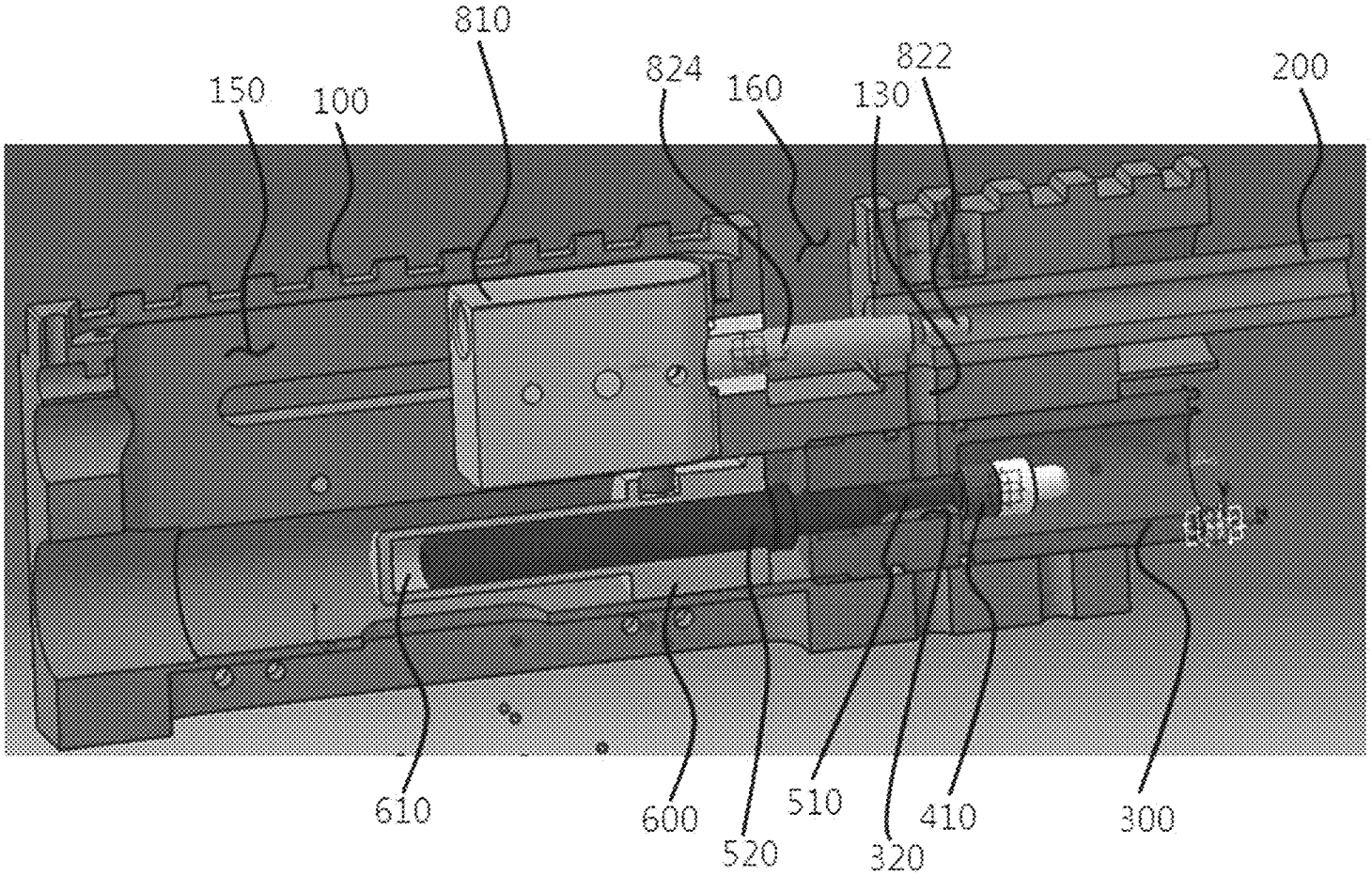

As a result, the hammer 600 and the hammer pusher 500 move at the same time toward the valve 300 to allow the blocking member 410 coupled to the front end periphery of the hammer pusher 500 and the blocking member cap 420 to move forwardly, so that as shown in FIG. 9, the pusher installation hole 320 is open to permit the compressed air existing in the valve 200 to be discharged therethrough.

At this time, as shown in FIG. 9, the front end peripheral portion 822 of the loading rod 820 moves forwardly in such a manner as to pass through the compressed air introduction hole 230 to allow the pellet to be pushed to a firing position, and the rear end peripheral portion 824 of the loading rod 820 closes the opposite side to the barrel 200.

In this state, as shown in FIG. 10, most of the compressed air discharged momentarily through the pusher installation hole 320 moves toward the barrel 200 through the first compressed air moving hole 330 and the compressed air introduction hole 230 to permit the pellet loaded to the firing position to be fired forwardly through the barrel 200.

Figure 11:
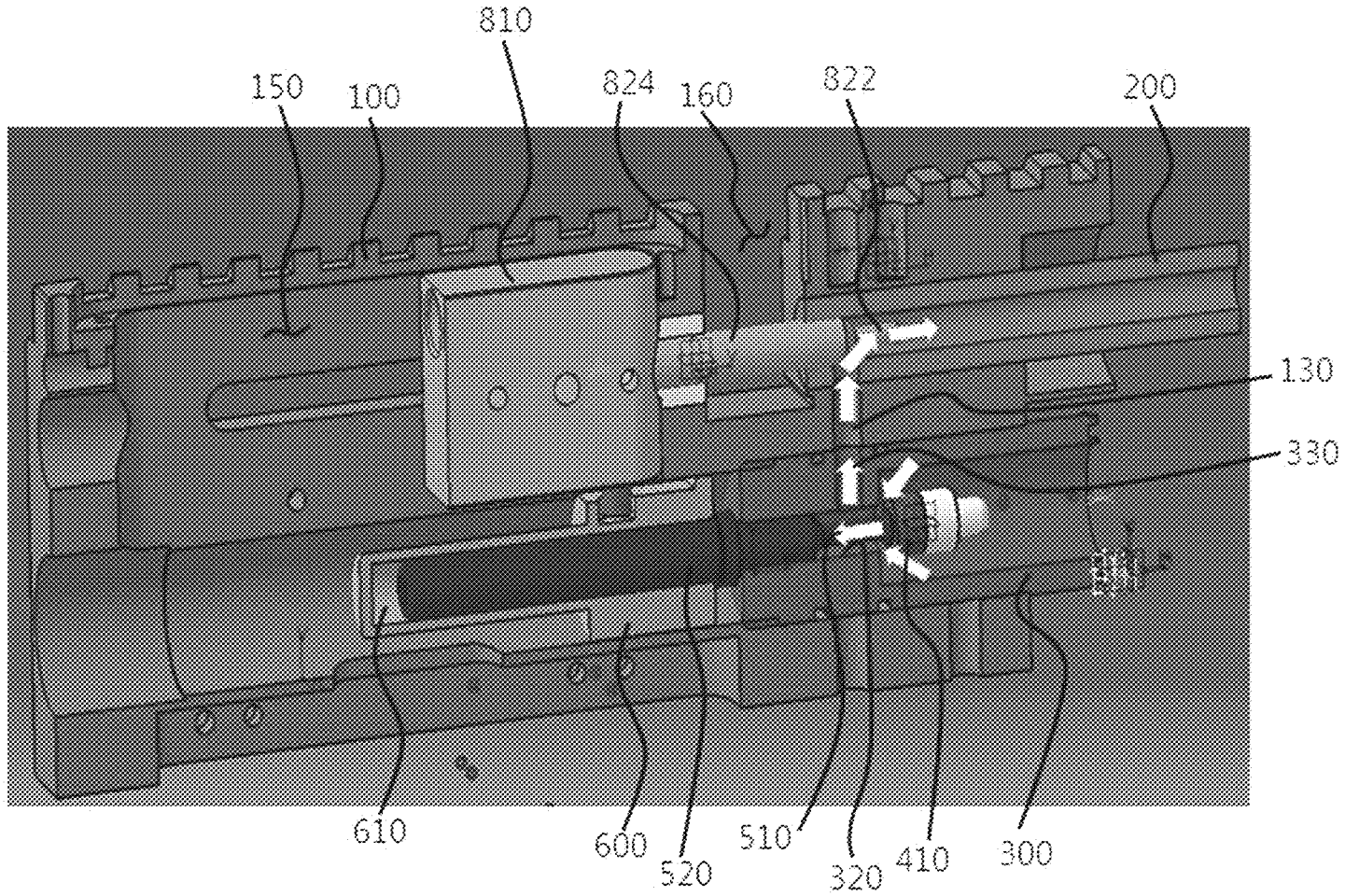

Further, as shown in FIG. 11, a portion of the compressed air moves toward the second compressed air moving hole 530, and as shown in FIG. 12, the compressed air passing through the second compressed air moving hole 530 moves to the pusher insertion groove 610 being in the closed state of the hammer 600 to allow the hammer 600 to be pressurized backwardly.

Figure 13:
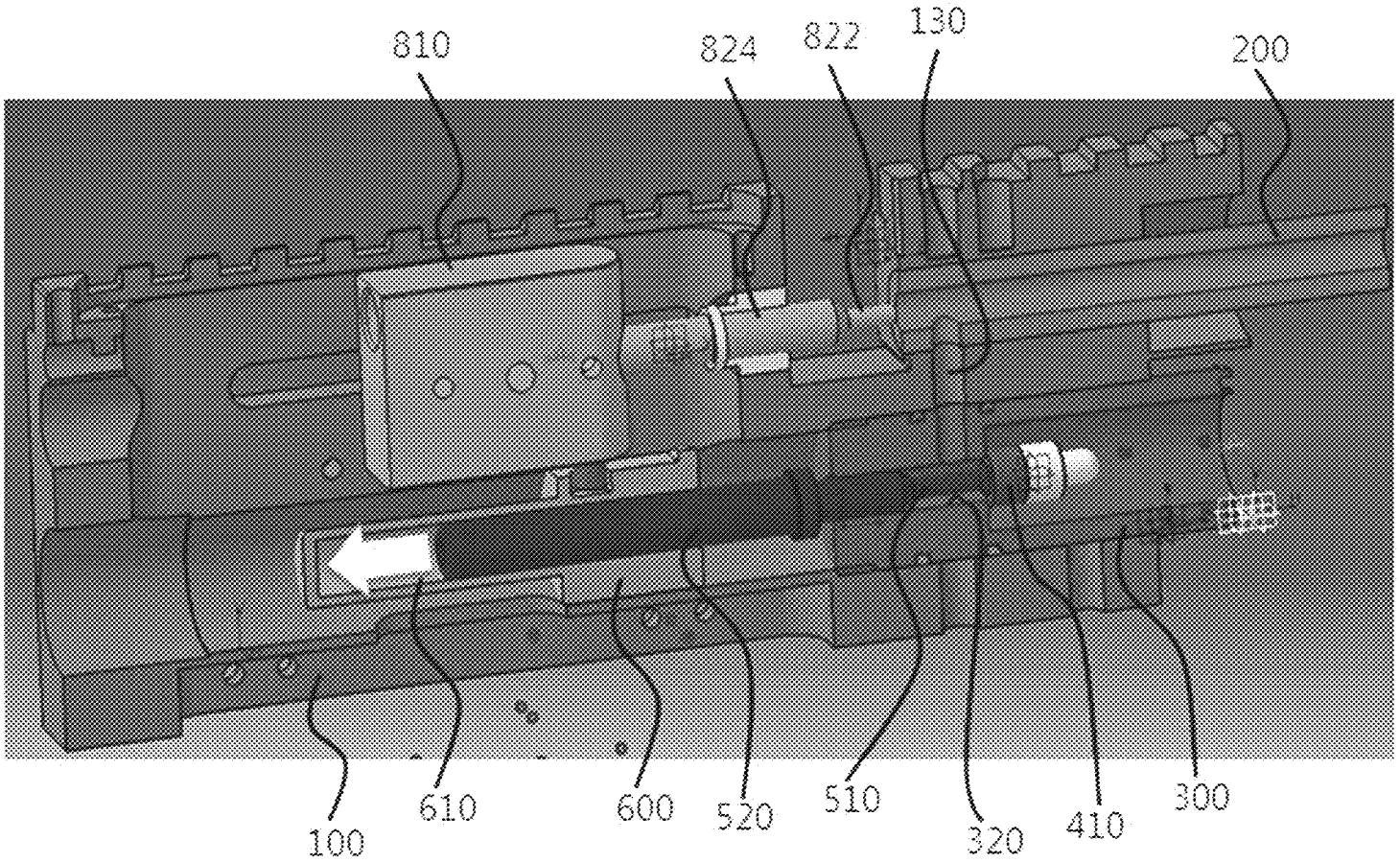

Furthermore, as shown in FIG. 13, the hammer 600 moves backwardly by means of a pressurizing force applied thereto, and the hammer pusher 500 becoming free and the valve control unit 400 connected to the hammer pusher 500 move backwardly by means of the elastic force of the first elastic member, so that the blocking member 410 blocks the pusher installation hole 320.

On the other hand, the hammer 600 moving backwardly by means of the pressurizing force moves backwardly to the maximum up to the position where the trigger unit-locked portion 630 is locked onto the locking projection 710 and is in a loaded state again. Of course, the loading housing 810 and the loading rod 820 move backwardly together with the hammer 600 to allow the pellet to be loaded again.

As the above processes are repeatedly carried out by means of the trigger pulling operation of the user, semi-automatic firing processes are repeatedly performed, so that the loading state of the pellet is achieved by means of a minimum amount of compressed air, thereby making it possible to fire pellets until the compressed air in the compressed air tank is completely consumed.

As described above, the semi-automatic air gun according to the present invention is capable of allowing the hammer to be loaded at the same time when the pellets are fired, with a portion of the compressed air discharged from the compressed air tank so as to fire the bullets, so that the hammer and the pellet loading unit move horizontally together to permit the loading and firing of the pellets to be carried out in a semi-automatic manner.

In addition, the semi-automatic air gun according to the present invention is simple in configuration and is in a loaded state with a minimum amount of compressed air, so that the pellets can be fired until the compressed air in the compressed air tank is completely consumed, thereby obtaining a remarkably excellent compressed air use efficiency.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A semi-automatic air gun comprising:

a main body;

a barrel fixedly located on a barrel installation hole formed on the main body and having a compressed air introduction hole formed on a front end thereof;

a valve fixedly disposed in a valve installation hole formed in parallel with the barrel installation hole of the main body to discharge air in a compressed air tank coupled to one end thereof toward the barrel;

a valve control unit horizontally movable in an internal space of the valve to control compressed air discharged through the valve;

a hammer pusher slidingly movably inserted into a pusher installation hole formed on the valve and having one end coupled to the valve control unit to move the valve control unit horizontally in such a manner as to allow a portion of the compressed air discharged from the valve to be supplied backwardly to move a hammer;

the hammer slidingly movable along a hammer moving path formed in the main body in such a manner as to insert another end of the hammer pusher thereinto and adapted to horizontally move the hammer pusher and the valve control unit in such a manner as to move backwardly by means of the compressed air supplied through the hammer pusher and to move forwardly by means of an elastic force of an elastic part disposed in the hammer moving path;

a trigger unit coupled to an underside of the main body and adapted to lock a lower end of a front end periphery of the hammer thereonto to prevent the hammer from moving forwardly in the state where the hammer moves backwardly and to move the hammer forwardly by means of a user's manipulation; and a pellet loading unit slidingly movable along a pellet loading unit installation groove formed in the main body and adapted to horizontally move together with the hammer to allow a pellet to be loaded into the barrel and to supply the compressed air supplied to the barrel toward the front side of the barrel, wherein the valve comprises: a control unit installation hole open toward the compressed air tank to provide a moving space of the valve control unit and a path for discharging the compressed air; the pusher installation hole open toward the hammer pusher in such a manner as to have a smaller diameter than the control unit installation hole and adapted to provide a sliding moving path of the hammer pusher; and a first compressed air moving hole formed to pass through a side wall of the valve toward the barrel from the pusher installation hole to provide a path along which the compressed air moves toward the barrel, and wherein the hammer pusher comprises: a small diameter part inserted into the pusher installation hole in such a manner as to be spaced apart from an inner peripheral surface of the pusher installation hole and to be coupled to the valve control unit at an end periphery thereof;

a large diameter part inserted into the pusher installation hole in such a manner as to be brought into close contact with the inner peripheral surface of the pusher installation hole and to be coupled to a rear end periphery of the small diameter part; a second compressed air moving hole formed to pass through an interior of the large diameter part in a longitudinal direction in such a manner as to have one end open toward the hammer and the other end open toward a small diameter part side end portion of the large diameter part; and a hammer locking portion protruding outwardly from an outer peripheral surface of the large diameter part and adapted to lock the front end periphery of the hammer thereonto upon a forward movement of the hammer to allow the hammer pusher to be pressurized toward the valve.

2. The semi-automatic air gun according to claim 1, wherein the valve control unit comprises:

a blocking member made of an elastic material to block an entrance of the pusher installation hole;

a blocking member cap made of a hard material and coupled to a rear end of the blocking member in such a manner as to be coupled to an end periphery of the hammer pusher; and a first elastic member disposed in the control unit installation hole to pressurize the blocking member and the blocking member cap toward the pusher installation hole by means of an elastic force thereof.

3. The semi-automatic air gun according to claim 1, wherein the hammer comprises:

a pusher insertion groove open toward the hammer pusher in such a manner as to allow the hammer pusher to come into close contact therewith; and a pin insertion groove concavedly formed on an outer surface of the hammer.

4. The semi-automatic air gun according to claim 3, wherein the pellet loading unit comprises:

a loading housing slidingly movable along the pellet loading unit installation groove in such a manner as to be connected to the hammer and to move horizontally together with the hammer;

a loading rod coupled to a front end of the loading housing in such a manner as to move forwardly and backwardly together with the loading housing and adapted to push the pellet into the barrel; and a connection pin coupled to an underside of the loading housing and having a lower end adapted to be inserted into the pin insertion groove to allow a horizontal movement of the hammer to be operated cooperatively with a horizontal movement of the loading housing.

5. The semi-automatic air gun according to claim 4, wherein the loading rod comprises:

a front end peripheral portion having a smaller diameter than an inner diameter of the barrel and adapted to move forwardly in such a manner as to pass through the compressed air introduction hole in the state of moving forwardly toward the barrel to allow the pellet to be pushed forwardly than the compressed air introduction hole; and a rear end peripheral portion having a given diameter capable of being brought into close contact with an inner peripheral surface of the barrel and adapted to connect the front end peripheral portion and the loading housing to each other at a rear end periphery of the front end peripheral portion.

* * * * *